US006435302B1

(12) United States Patent
Chen

(10) Patent No.: US 6,435,302 B1
(45) Date of Patent: Aug. 20, 2002

(54) MOTOR VEHICLE MUFFLER

(76) Inventor: Shun-Lai Chen, No. 534-1, Sec. 1, Yuan Shui Rd., Yuanlin Chen, Changhwa Hsien (TW)

( * ) Notice: Subject to any disclaimer, the term of this patent is extended or adjusted under 35 U.S.C. 154(b) by 19 days.

(21) Appl. No.: 09/740,834

(22) Filed: Dec. 21, 2000

(51) Int. Cl.[7] ..... F01N 1/10

(52) U.S. Cl. ..... 181/252; 181/256; 181/265; 181/251

(58) Field of Search ..... 181/247, 248, 181/249, 250, 251, 252, 255, 256, 257, 265, 238, 239, 282

(56) References Cited

U.S. PATENT DOCUMENTS 2,290,818 A * 7/1942 Tyskewicz ..... 181/265
3,993,160 A * 11/1976 Rauch ..... 181/252
4,381,045 A * 4/1983 Buchwalder ..... 181/265

* cited by examiner

*Primary Examiner*—Khanh Dang
(74) *Attorney, Agent, or Firm*—Varndell & Varndell, PLLC

(57) ABSTRACT

A motor vehicle muffler having a muffler loop installed in a casing in the exhaust pipe of a motor vehicle, the muffler loop formed of three muffler tubes and two connecting tubes, the muffler tubes being arranged at different elevations in the casing and crossed by one another at the same point, the connecting tubes being arranged in parallel outside the casing to connect the muffler tubes in series.

2 Claims, 5 Drawing Sheets

MOTOR VEHICLE MUFFLER

BACKGROUND AND SUMMARY OF THE INVENTION

The present invention relates to a motor vehicle muffler and, more particularly, to such a motor vehicle muffler, which comprises a casing stuffed with a stuffing sponge material, and a muffler loop installed in the casing and adapted to soften sound from waste gas passing through, the muffler loop being formed of crossed muffler tubes, and connecting tubes that connect the crossed muffler tubes in series.

A regular motor vehicle muffler, as shown in FIG. 1, is generally comprised of a cylindrical casing, a first muffler tube connected between the front and rear ends of the casing for input of waste gas, a second muffler tube connected between the front and rear ends of the casing in parallel to the first muffler tube for output of waste gas, and a connecting tube suspended outside the casing to connect the first muffler tube and the second muffler tube in parallel. The muffler tubes each have a plurality of muffling holes arranged around the periphery. This structure of motor vehicle muffler is still not satisfactory in function. When waste gas escapes out of the muffling holes of the muffler tubes, the currents of waste gas from the first muffler tube may conflict with the currents of waste gas from the second muffler tube, causing an unstable sound frequency or resonance.

The invention has been accomplished to provide a motor vehicle muffler, which eliminates the aforesaid drawbacks. It is one object of the present invention to provide a motor vehicle muffler, which effectively soften sound. It is another object of the present invention to provide a motor vehicle muffler, which greatly improves the combustion efficiency of the motor vehicle and, reduces the amount of incomplete combustion gas. According to the present invention, the motor vehicle muffler comprises a casing stuffed with a stuffing sponge material, and a muffler loop installed in the casing and adapted to soften sound from waste gas passing through. The muffler loop is comprised of three muffler tubes connected between front and rear sidewalls of the casing at different elevations and crossed by one another at the same point, and connecting tubes suspended outside the casing and connecting the crossed muffler tubes in series.

DETAILED DESCRIPTION OF THE PREFERRED EMBODIMENT

Figure 1:
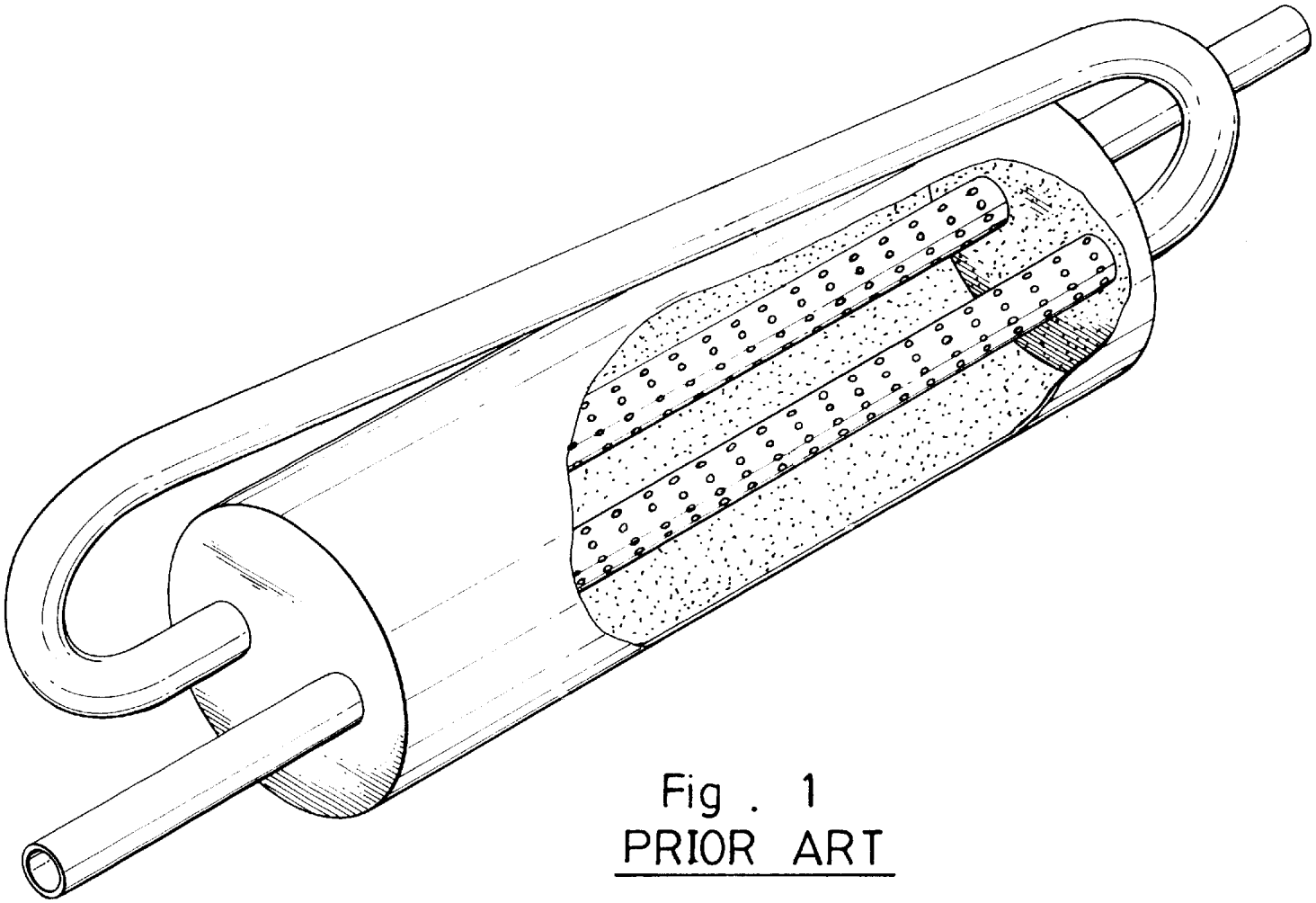
Fig. 1 PRIOR ART
FIG. 1 is a cutaway view of a motor vehicle muffler according to the prior art.
Figure 2:
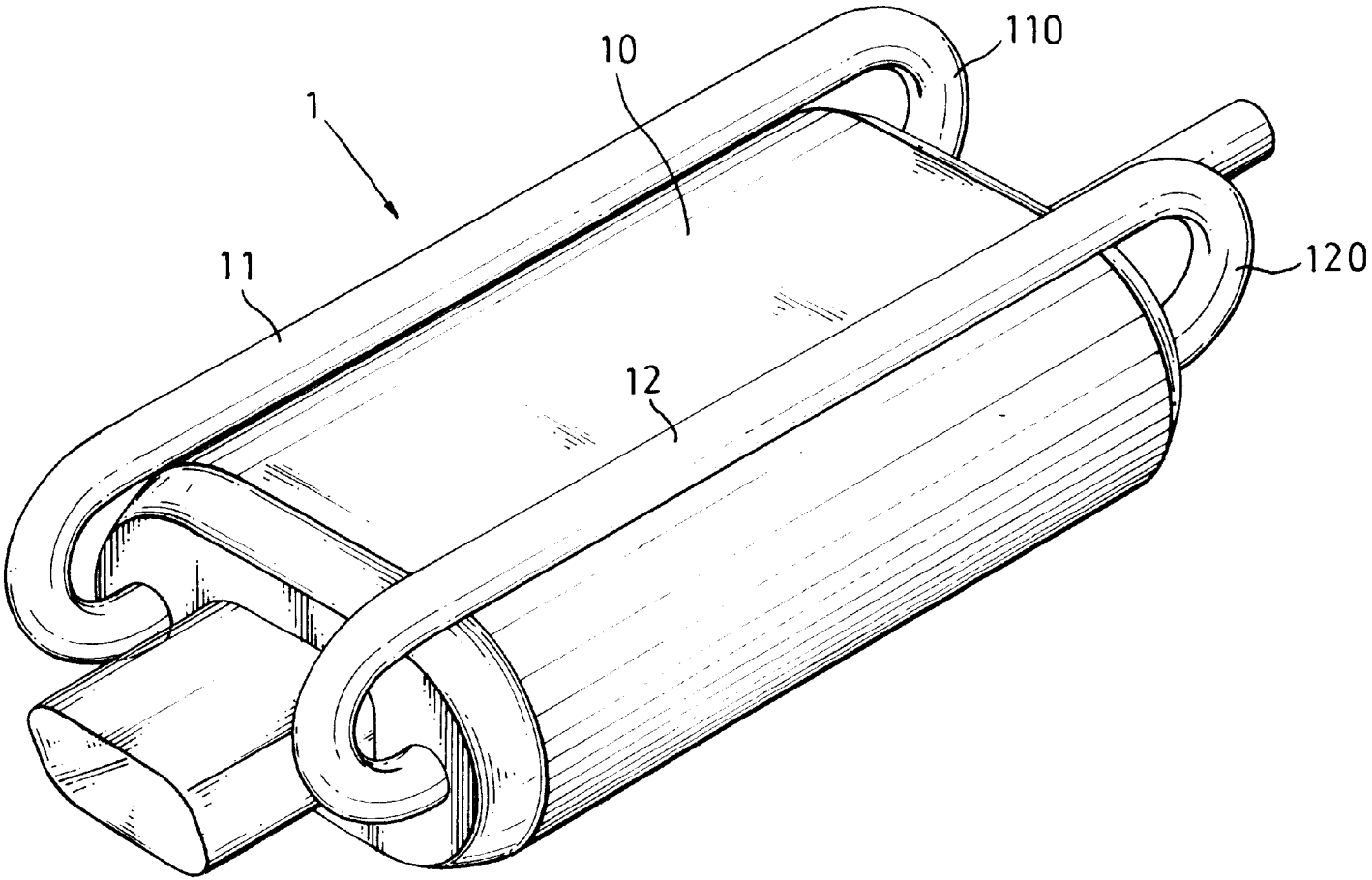
FIG. 2 is an elevational view of a motor vehicle muffler according to the present invention.
Figure 3:
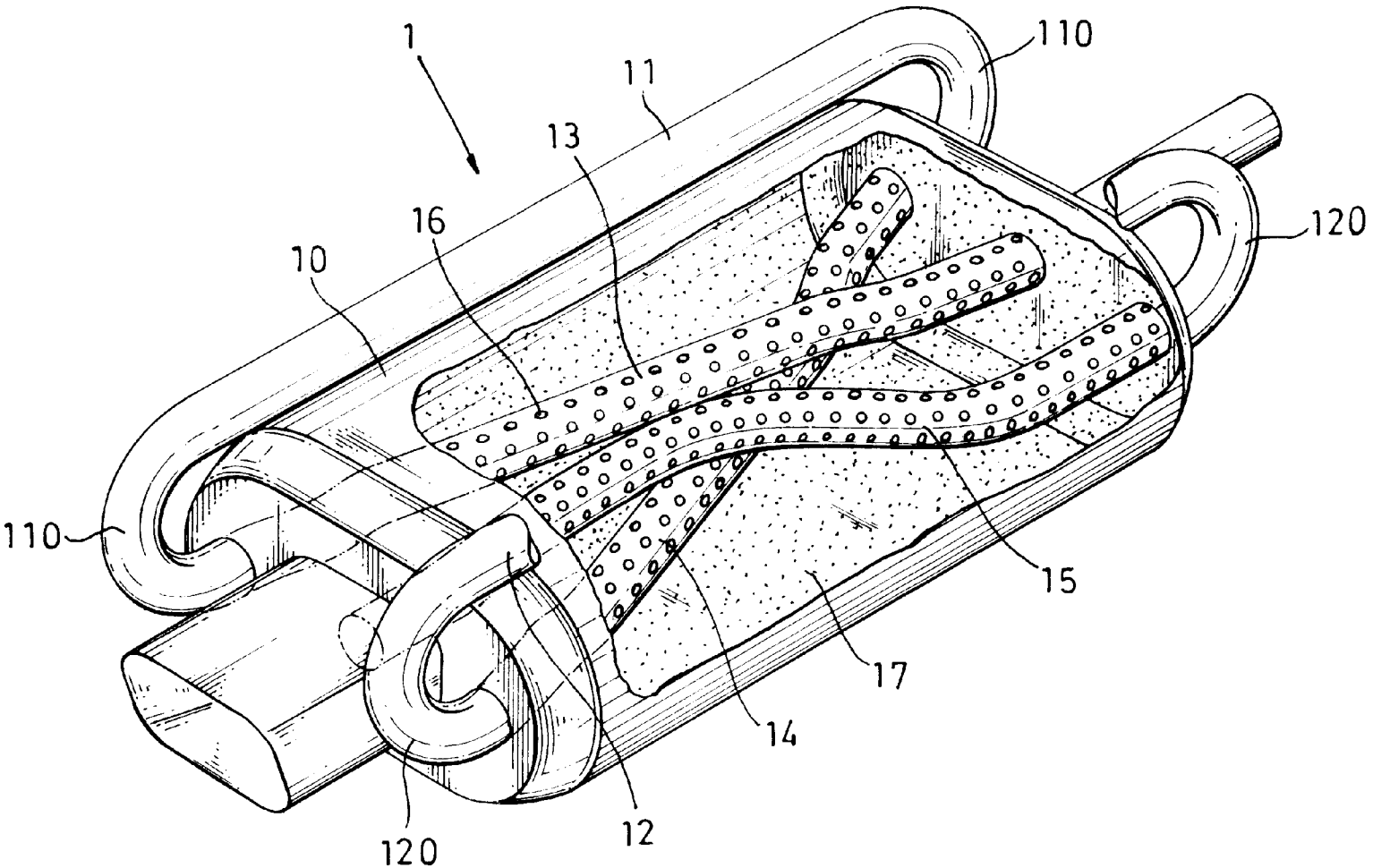
FIG. 3 is a cutaway view of the motor vehicle muffler according to the present invention.
Figure 4:
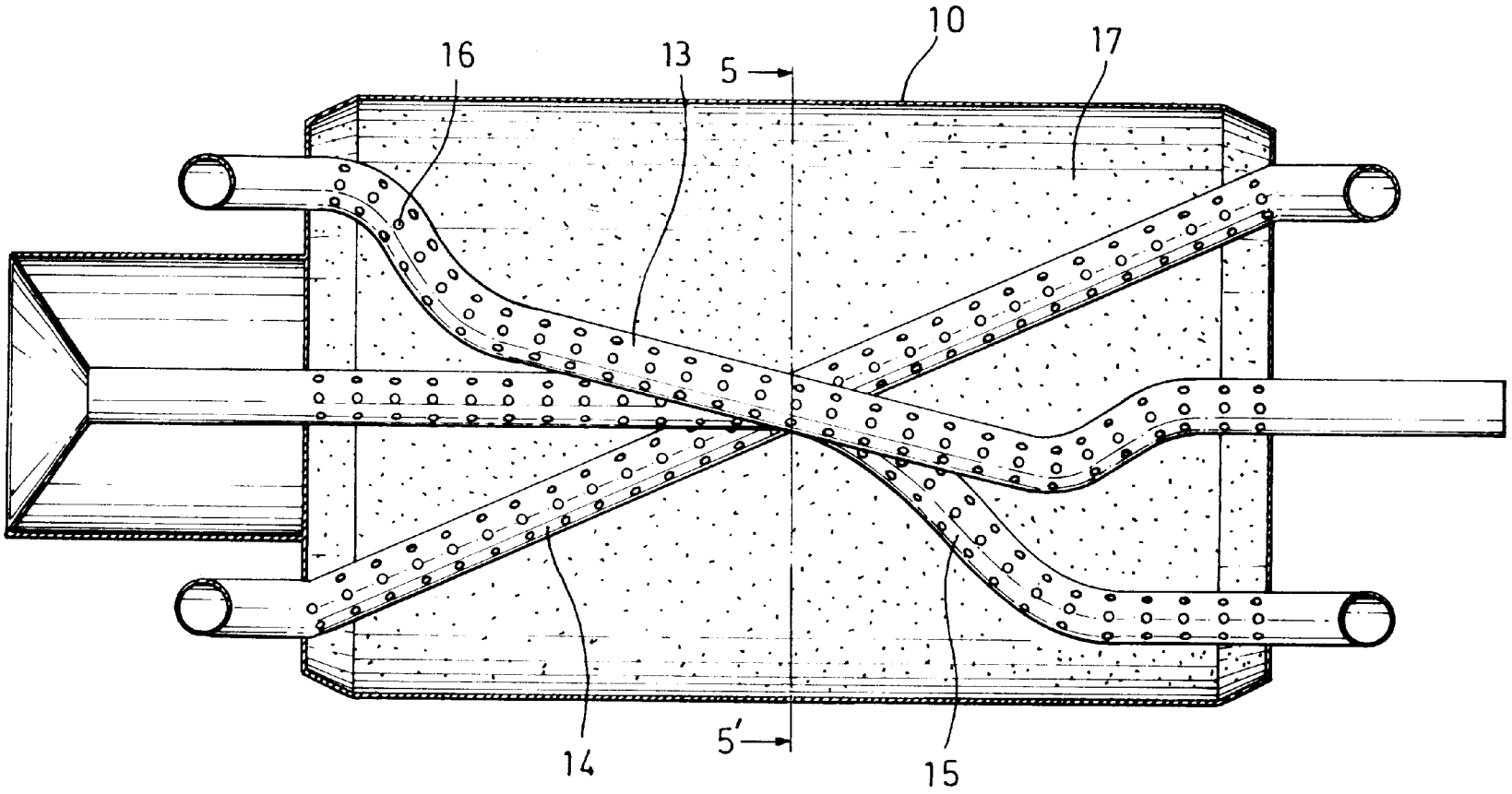
FIG. 4 is a sectional top view of the motor vehicle muffler according to the present invention.
Figure 5:
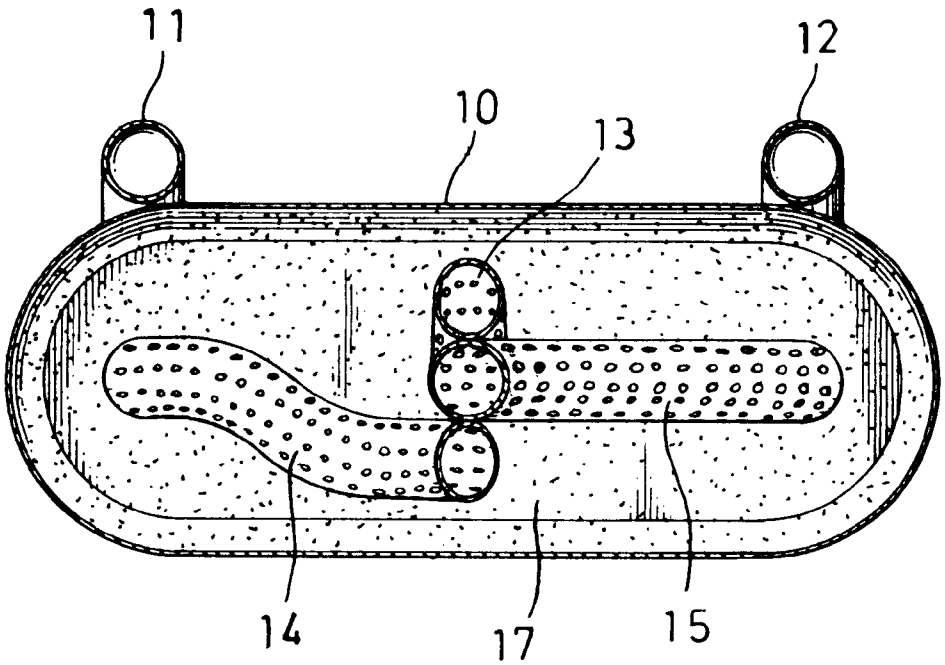
FIG. 5 is a sectional view taken along line 5—5 of FIG. 4.

Referring to Figures from 2 through 5, a muffler 1 is shown comprising a casing 10, three muffler tubes, namely, the first muffler tube 13, the second muffler tube 14 and the third muffler tube 15 installed in the casing 10, two connecting tubes, namely, the first connecting tube 11 and the second connecting tube 12 mounted outside the casing 10, and stuffing sponge material 17. The muffler tubes 13, 14 and 15 each have a front end connected to the front sidewall of the casing 10, a rear end connected to the rear sidewall of the casing 10, and a plurality of muffling holes 16 for softening sound. The first muffler tube 13 is obliquely connected between the front and rear sidewalls of the casing 10, having its front end extended out of the front sidewall of the casing 10 and connected to the exhaust port of the engine of the motor vehicle in which the muffler 1 is installed. The second muffler tube 14 is obliquely connected between the front and rear sidewalls of the casing 10 and crossed by the first muffler tube 13. The third muffler tube 15 is a curved tubular member connected between the front and rear sidewalls of the casing 10 and crossed by the second muffler tube 14. The rear end of the third muffler tube 15 is connected to the exhaust pipe (not shown) for output of waste gas. The first connecting tube 11 has two bents 110 extended from two ends thereof and respectively connected to the rear end of the first muffler 13 and the front end of the second muffler 14. The second connecting tube 12 has two bents 120 extended from two ends thereof and respectively connected to the front end of the third muffler tube 15 and the rear end of the second muffler tube 14. The stuffing sponge material 17 is packed tightly in the casing 10 around the muffler tubes 13, 14 and 15. When assembled, the muffler tubes 13, 14 and 15 are disposed at different elevations, and crossed by one another at one point.

When in use, waste gas flows in proper order through the first muffler tube 13, the first connecting tube 11, the second muffler tube 14, the second connecting tube 12 and the third muffler tube 15, and then flows out of the exhaust pipe of the motor vehicle. When waste gas passing through the first muffler tube 13, a small amount of waste gas passes out of the muffling holes 16 of the first muffler tube 13 into the stuffing sponge material 17, and the major of waste gas passes through the first connecting tube 11 to the second muffler tube 14. When passing through the second muffler tube 14, a small amount of waste gas passes out of the muffling holes 16 of the second muffler tube 14 to buffer the escaped currents of waste gas from the muffling holes 16 of the first muffler tube 13. Similarly, when passing through the third muffler tube 15, a small amount of waste gas passes out of the muffling holes 16 of the third muffler tube 15 to buffer the escaped currents of waste gas from the first muffler tube 13 and the second muffler tube 14. The muffler tubes 13, 14 and 15 and the connecting tubes 11 and 12 form a long muffler loop that improves the torque of the motor vehicle. Because waste gas stays much time in the long muffler loop, less noise is produced, and the combustion efficiency of the motor vehicle is relatively improved.

While only one embodiment of the present invention has been shown and described, it will be understood that various modifications and changes could be made thereunto without departing from the spirit and scope of the invention disclosed.

What is claimed is:

1. A motor vehicle muffler comprising a casing installed in the exhaust pipe of a motor vehicle, said casing having a front sidewall and a rear sidewall, and a muffler loop installed in said casing and extended through the front and rear sidewalls of said casing and adapted to soften sound upon flowing of waste gas from said motor vehicle through said exhaust pipe, wherein said muffler loop comprises:

a first muffler tube obliquely connected between the front sidewall and rear sidewall of said casing, said first muffler tube having a plurality of muffling holes arranged around the periphery thereof, a front end for input of waste gas from said motor vehicle, and a rear end;

a second muffler tube obliquely connected between the front sidewall and rear sidewall of said casing and crossed by said first muffler tube, said second muffler tube having a plurality of muffling holes arranged around the periphery thereof, a front end, and a rear end;

a third muffler tube connected between the front sidewall and rear sidewall of said casing and crossed by said second muffler tube, said third muffler tube having a plurality of muffling holes arranged around the periphery thereof, a front end, and a rear end for output of waste gas;

a first connecting tube suspended outside said casing, said first connecting tube having a front bent connected to the front end of said second muffler tube, and a rear bent connected to the rear end of said first muffler tube; and a second connecting tube suspended outside said casing, said second connecting tube having a front bent connected to the front end of said third muffler tube, and a rear end connected to the rear end of said second muffler tube.

2. The motor vehicle muffler of claim 1 wherein said first muffler tube, said second muffler tube and said third muffler tube are arranged at different elevations and crossed by one another at one point.

* * * * *